US008692645B2

(12) United States Patent
Ciesielski

(10) Patent No.: US 8,692,645 B2
(45) Date of Patent: Apr. 8, 2014

(54) DISCONNECTOR FOR ELECTRIC POWER EQUIPMENT FILLED WITH DIELECTRIC LIQUID

(75) Inventor: Slawomir Ciesielski, Zgierz (PL)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/388,760

(22) PCT Filed: Jun. 30, 2010

(86) PCT No.: PCT/EP2010/004104

§ 371 (c)(1),
(2), (4) Date: Feb. 3, 2012

(87) PCT Pub. No.: WO2011/015263

PCT Pub. Date: Feb. 10, 2011

(65) Prior Publication Data

US 2012/0133479 A1 May 31, 2012

(30) Foreign Application Priority Data

Aug. 7, 2009 (EP) ..... 09460035

(51) Int. Cl.
*H01H 85/04* (2006.01)

(52) U.S. Cl.
USPC ..... 337/148; 337/142; 337/143; 337/144; 337/145; 337/146; 337/283; 337/204

(58) Field of Classification Search
USPC ..... 337/283, 142–146, 148, 204
See application file for complete search history.

(56) References Cited

U.S. PATENT DOCUMENTS

| | | | | |
|---|---|---|---|---|
| 1,989,485 | A * | 1/1935 | Marti | 363/52 |
| 2,509,935 | A * | 5/1950 | Nelson | 174/14 R |
| 4,743,996 | A * | 5/1988 | Book | 361/39 |
| 5,898,556 | A * | 4/1999 | de Sedouy et al. | 361/37 |
| 6,839,207 | B2 * | 1/2005 | Folliot et al. | 361/38 |
| 7,755,868 | B2 * | 7/2010 | Flores Losada | 361/35 |

FOREIGN PATENT DOCUMENTS

| | | | |
|---|---|---|---|
| EP | 0817346 | 1/1998 | H02H 7/04 |
| EP | 1122848 | 8/2001 | H02H 7/04 |
| EP | 1783796 A2 * | 5/2007 | H01H 35/18 |

OTHER PUBLICATIONS

International Search Report in corresponding application PCT/EP210/004104 mailed Aug. 20, 2010.
Written Opinion in corresponding application PCT/EP210/004104 mailed Feb. 7, 2012.

* cited by examiner

*Primary Examiner* — Anatoly Vortman
(74) *Attorney, Agent, or Firm* — Renner Kenner Greive Bobak Taylor & Weber

(57) ABSTRACT

A disconnector for electric power equipment filled with dielectric liquid, especially transformers, applicable in protecting the operation of electric power equipment. The disconnector contains at least two cylindrical current-limiting fuses situated inside a tank, and each fuse is electrically connected with external phase power supply and through fixed contacts and moving contacts of the disconnector with the active part of the piece of electric power equipment. The disconnector is characterized in that the current-limiting fuses are placed in a common housing, in which a slide with a pilot is situated, and to the slide there are inseparably fixed moving contacts, which move together with the slide when the slide makes a to-and-fro motion. The to-and-fro motion takes place as a result of the operation of a tripping device situated in the current-limiting fuses and of the compression or stretching of springs fixed to the pilot and to a fixing disk.

4 Claims, 4 Drawing Sheets

DISCONNECTOR FOR ELECTRIC POWER EQUIPMENT FILLED WITH DIELECTRIC LIQUID

CROSS-REFERENCE TO RELATED APPLICATION

This is a §371 application of International patent application number PCT/EP2010/004104 filed Jun. 30, 2010, which claims priority of European patent application number 09460035.0 filed on Aug. 7, 2009, both of which are incorporated herein by reference.

TECHNICAL FIELD

The subject of the invention is a disconnector for electric power equipment filled with dielectric liquid, and especially for transformers, applicable in protecting the operation of electric power equipment.

BACKGROUND ART

Electric power equipment, and especially transformers filled with dielectric liquid, operating in medium and/or high voltage networks, contain protective systems whose purpose is to eliminate the effects of various failures and to disconnect the power supply system from the network if an internal fault occurs in the transformer. The protective systems contain current-limiting fuses with tripping devices which control the disconnector and which are coupled with a control sensor used to control the pressure and level of oil inside the transformer tank. Exceeding the predetermined parameters of oil level or pressure results in shorting of fuses, and consequently in the disconnection of the transformer. In known solutions protecting transformers against internal faults, the disconnector whose movable contacts are situated on a rotary strip, contains current-limiting fuses, fixed to the rotary strip and suitably spaced in one row, the spacing resulting from the dimensions of the external insulators in which the current-limiting fuses are placed.

A device protecting against the effects of internal voltage surges in electrical equipment, and especially in a distribution transformer, is know from patent description EP 0817346. This devise is immersed in the dielectric liquid of the earthed tank of the transformer and it is connected with the structure of the active part of the transformer. The protective device contains a phase disconnection system and devices for detecting the flow of earth current between earth and the structure of the active part of equipment. The phase disconnection system which is provided with blocking devices with fixed contacts is attached to the rotary rod of the disconnector. In the closed position of the disconnector, the fixed contacts contact the tripping devices of the fuses. If one of the fuses blows, the freed tripping device, through a contact with a lever connected with the rod of the three-phase disconnector, causes a turn of the rod and the disconnection of the other fuses from the power supply system.

There are known TPC oil transformers, manufactured by Transfix Toulon, which contain a disconnector situated in the oil transformer tank and three or two medium voltage fuses, situated vertically in the tank. The fuses together with the tripping devices are situated in bushings which are fixed in one row to a rotary rod of a three- or two-phase disconnector which is situated in the bottom or upper part of the transformer tank. The disconnector is activated by the tripping device if a fuse blows. The use of vertical bushings with fuses arranged in a row in relation to the rotary rod of the disconnector causes that the disconnector occupies relatively much space inside the transformer tank.

SUMMARY OF THE INVENTION

The essential quality of the inventive disconnector, containing at least two cylindrical current-limiting fuses which are situated inside the tank and each fuse is electrically connected with external phase power supply and, through fixed contacts and moving contacts of the disconnector, with the active part of the electric power equipment, is that the current-limiting fuses are situated in a common housing in which a slide with a guide is situated. Moving contacts are inseparably attached to the slide and the contacts move together with the slide during the to-and-fro motion. The to-and-fro motion takes place as a result of the action of the tripping device situated in the current-limiting fuses and of compression or stretching of springs attached to the slide guide and to a fixing disk.

The disconnector contains three cylindrical current-limiting fuses which are situated in a common housing in such way that the longitudinal axes of the fuses are parallel to one another, and the projection of their longitudinal axes on a plane perpendicular to them determines three points which when connected with one another form the vertexes of a triangle in whose area the projection of the axis of the travel of the slide is situated.

In another embodiment the disconnector contains two cylindrical current-limiting fuses and a jumper, all of which are situated in a common housing in such way that the longitudinal axes of the fuses and the longitudinal axis of the jumper are situated parallel to one another, and the projection of the longitudinal axes of the fuses and of the jumper on a plane perpendicular to them determines three points which when connected with one another form the vertexes of a triangle in whose area the projection of the axis of the travel of the slide is situated.

In some embodiments, the jumper may contain cylindrical shorting contacts which are connected with each other by a conducting spindle.

In some embodiments, the cylindrical shorting contacts may have a diameter equal to the diameter of the cylindrical fuses.

In some embodiments, the moving contacts in the open position of the disconnector are in contact with a grounded fixing disk.

In some embodiments, the disconnector housing is fixed inside the transformer tank.

In other embodiments, the disconnector housing is fixed to the cover of the transformer tank.

The advantage of the inventive disconnector is its compact design allowing the construction of electric power equipment, and especially a transformer, of a smaller weight and dimensions. Making the insulating gap between the contacts by linear and not rotary movement allows to maintain the required insulating distances between the equipment contacts, both when the transformer is filled with oil and in an emergency situation, when the oil level drops, and therefore it ensures three-phase disconnection of the transformer from the power supply network. Smaller number of the disconnector components, and especially the absence of individual, complex insulators for current-limiting fuses permits not only a decrease in the weight and dimensions but it also allows to avoid assembly errors, because adjustment of the relative position of the fixed and moving contacts is no longer required.

BRIEF DESCRIPTION OF THE DRAWINGS

The inventive disconnector is presented as an embodiment in the drawing where.

BEST MODE FOR CARRYING OUT THE INVENTION

Figure 1:
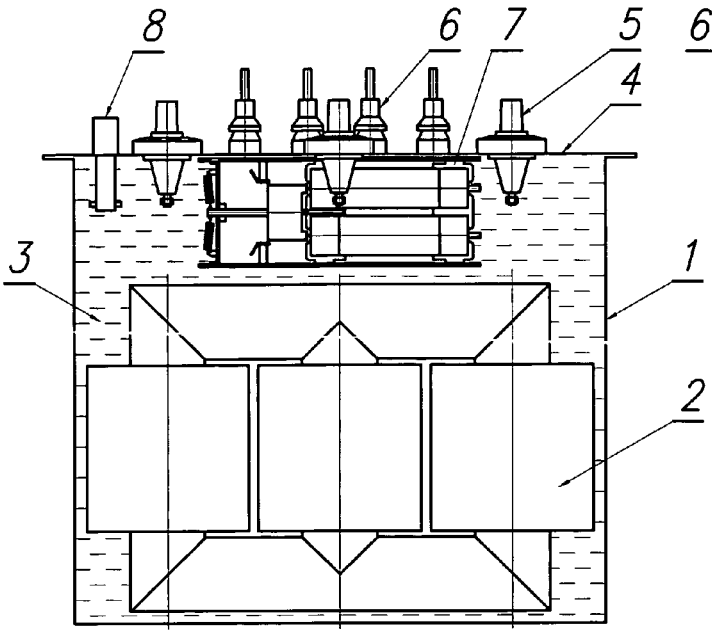
FIG. 1 shows schematically the transformer tank with the active part placed in it and with the inventive disconnector in a position shown from the longer side of the tank after removing the transformer wall.
Figure 2:
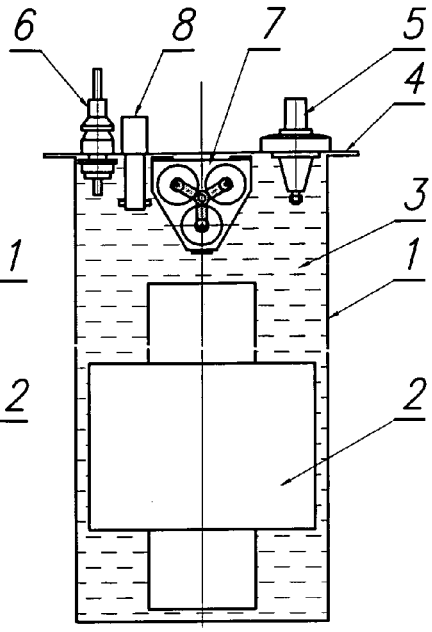
FIG. 2 shows schematically the transformer tank with the active part placed in it and with the inventive disconnector in a position shown from the shorter side of the tank after removing the transformer wall.
Figure 4:
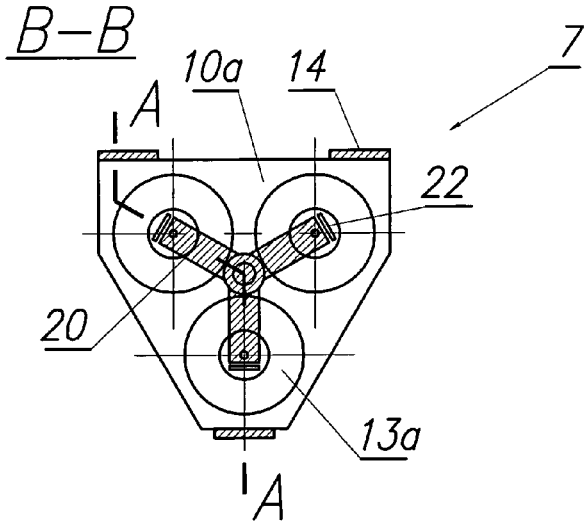
FIG. 4 shows the disconnector in frontal section along line B-B.
Figure 3:
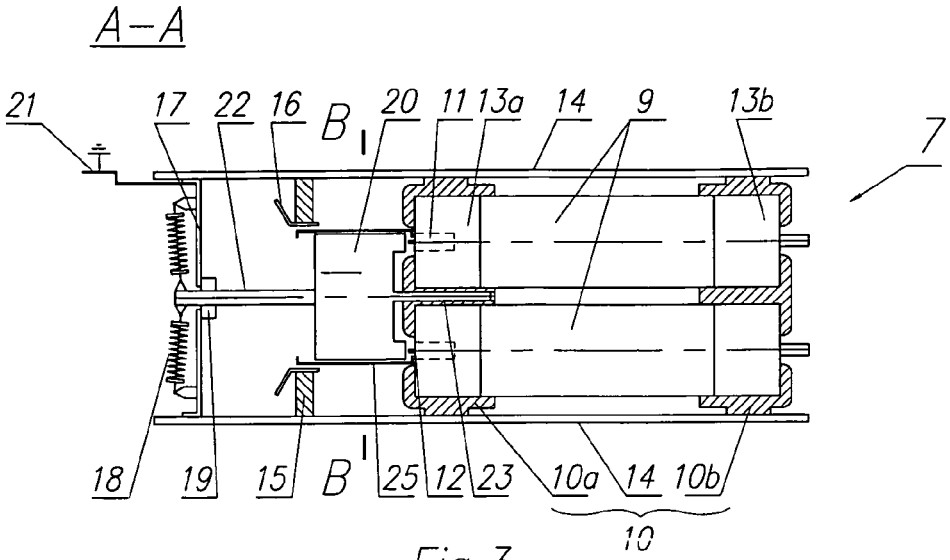
FIG. 3 shows the disconnector in side section along line A-A in closed state.
Figure 5:
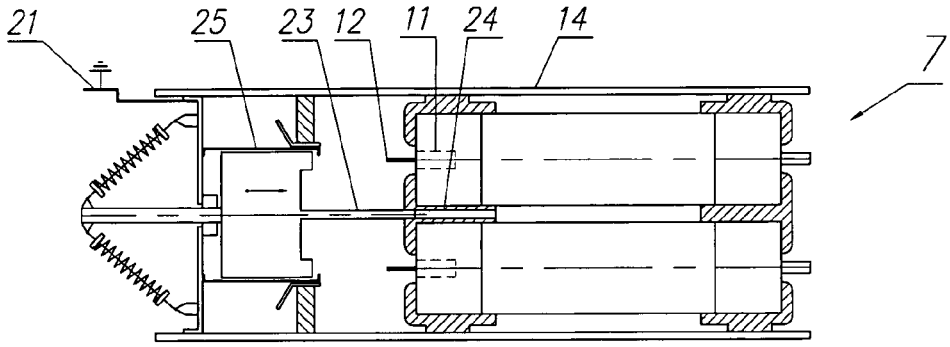
FIG. 5 shows the disconnector from FIG. 3 in open state.
Figure 7:
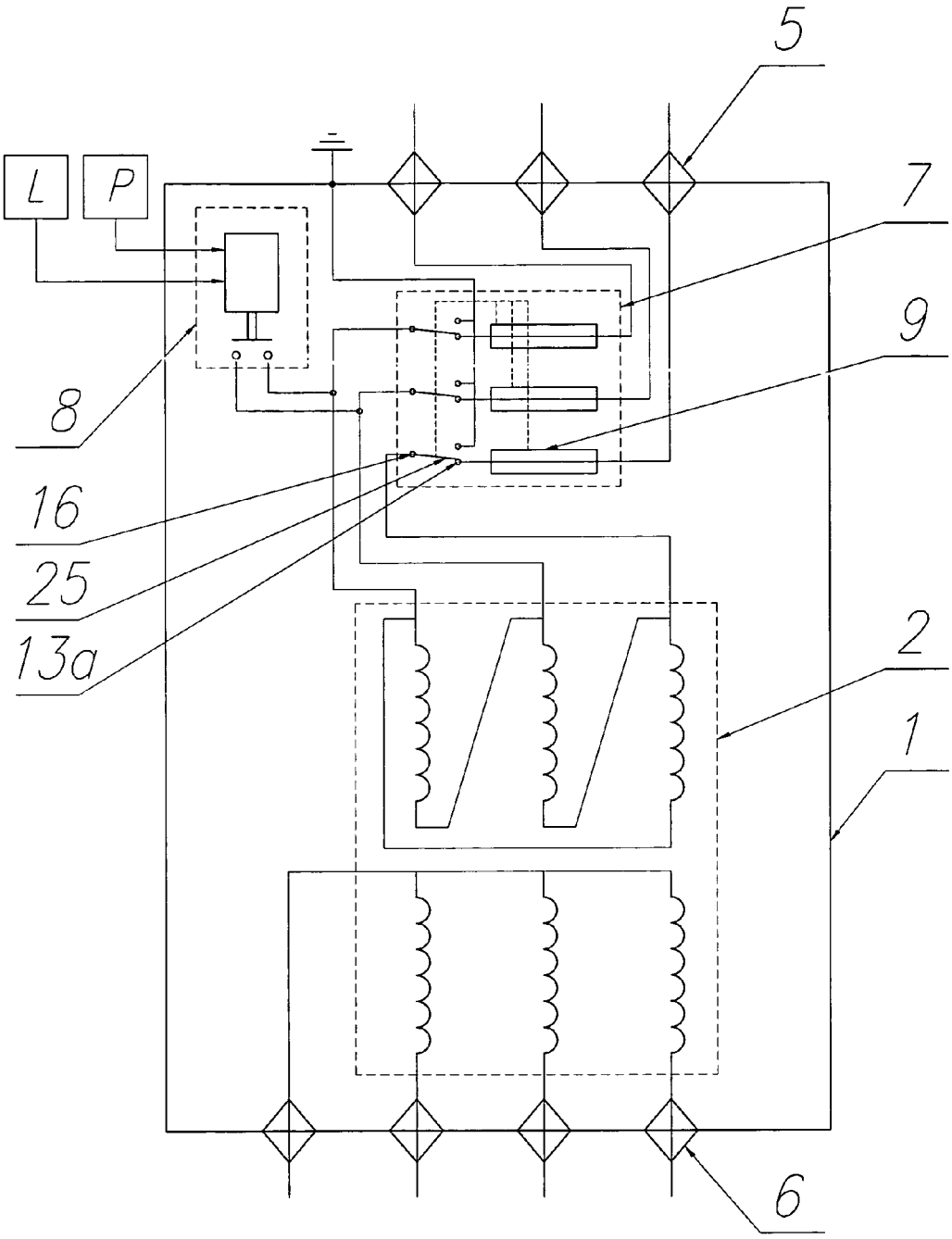
FIG. 7 shows the wiring diagram of the transformer containing the inventive disconnector in an embodiment with three fuses.
Figure 8:
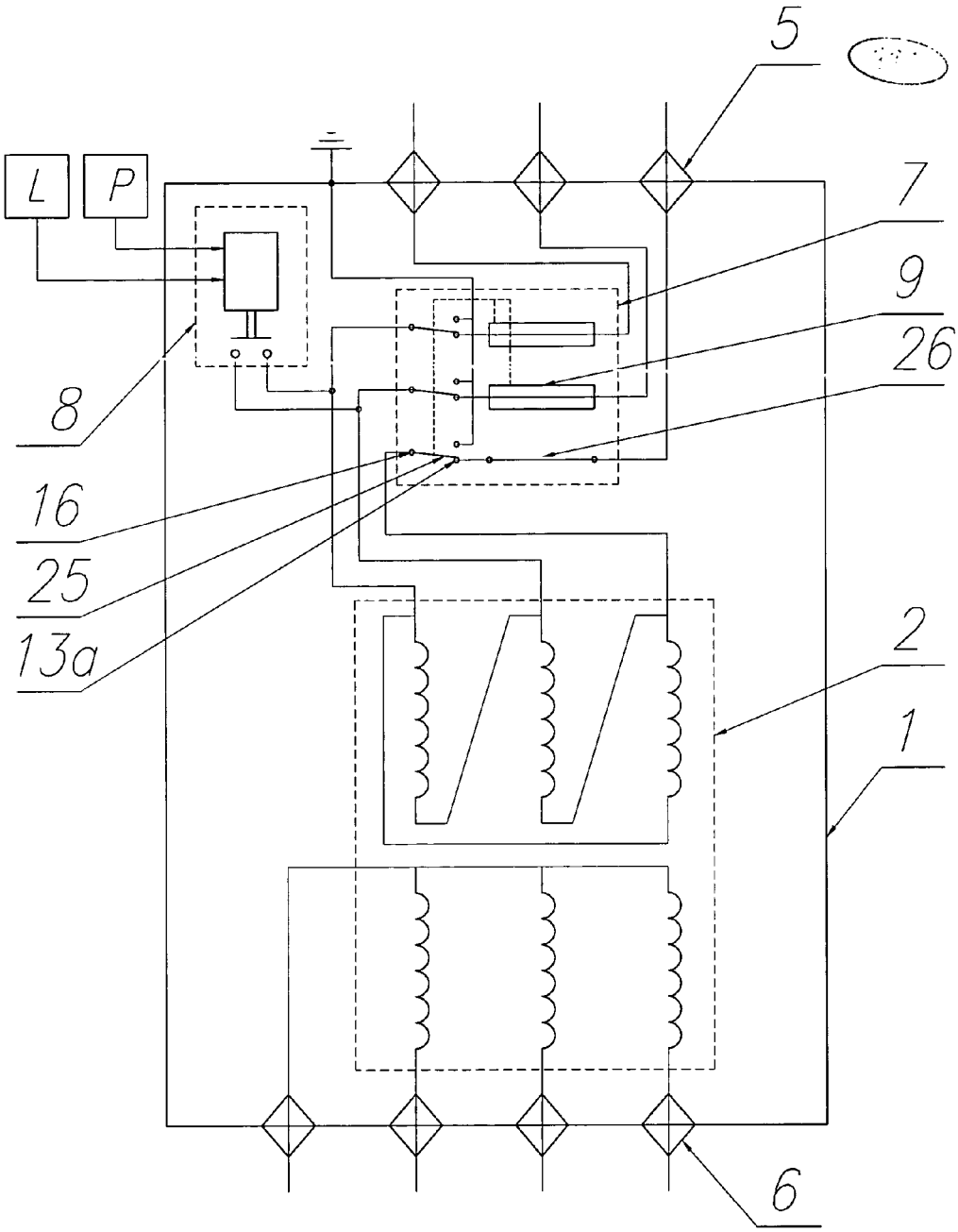
FIG. 8 shows the wiring diagram of the transformer containing the inventive disconnector in an embodiment with two fuses and one jumper.

A piece of electric power equipment in the form of a distribution transformer contains a tank 1 which houses the active part of the transformer 2, schematically shown in FIG. 1, FIG. 3, FIG. 7 and FIG. 8, containing a magnetic core and the primary and secondary windings of the transformer. The active part 2 is situated in the tank 1 and it is immersed in oil 3. The tank 1 is closed with a cover 4 in which high voltage bushings 5 are fixed, through which bushings the active part 2 of the transformer is energized, and low voltage bushings 6 through which voltage from the secondary winding of the active part 2 is collected. The bushings 5 and 6 can also be fixed in the side walls of the containing tank, which is not shown in the drawing. To the inner side of the cover 4 there is attached a disconnector 7 which is electrically coupled with the contacts of an oil pressure and level sensor 8, where letter "L" means oil level, and letter "P" pressure, which is shown in FIG. 7 and FIG. 8. The disconnector 7 in the first embodiment of the invention contains three cylindrical current-limiting fuses 9 whose longitudinal axes are situated parallel to one another and to the cover 4. The fuses 9 are fixed in a common housing 10 in such way that, in the cross-section of the disconnector, the lines connecting the longitudinal axes of the fuses 9 form a triangle, preferably an equilateral triangle, in whose vertexes the longitudinal axes of these fuses are situated. Each of the fuses 9 is provided with a tripping device 11, marked with a dashed line in FIGS. 3, 4 and 5, containing a pin 12. The housing 10 contains a front holder 10*a* and a back holder 10*b* in which there are placed conducting contacts 13*a* and 13*b* respectively, situated on both ends of each fuse 9. The holders 10*a* and 10*b* are connected with each other by connecting rods 14. To the connecting rods 14 there is attached an insulating ring of fixed contacts 15 with fixed contacts 16 and a fixing disk 17 to whose outer face springs 18 are radially attached and which is furnished with a guide 19 of a slide 20. The fixing disk 17 is galvanically connected with the transformer cover 4 by means of a brass grounding strip 21, which causes that the disk 17 is effectively grounded through the containing tank 1 of the transformer. In the guide 19 there is a pilot 22 connected with the slide 20, to whose end the ends of the springs 18 are fastened. The slide 20 has a guiding pin 23 which is situated on the opposite side of the pilot 22. The dimensions of the guiding pin 23 match the dimensions of a port 24 made in the front holder 10*a*, in the cross-section plane in the axis of the travel of the slide 20. On the slide 20 there are installed three (3) moving contacts 25 in the form of brass profiles bent on both ends, which in the closed state of the disconnector touch on one end the fixed contact 16, and on the other end they touch the conducting contact 11*a*. The tripping device 11 of the fuses 9 contains the pin 12 which at the moment of operation of the fuse strikes the moving contact 25 fixed on the slide 20.

The operation of the disconnector according to this invention is as follows. The fuses 9 which are secured in holders 10*a* and 10*b* are arranged axially and symmetrically around the longitudinal axis which is parallel to the axis of travel of the slide 20 which moves together with moving contacts 25 situated on it. In closed state shown in FIG. 3, the slide 20 is in the extreme right position in which the fixed contacts 16 attached to the insulating ring 15 are connected through the moving contacts 25 with the conducting contact 13*a* of the fuse 9. Voltage from the high voltage bushing 5 is supplied to the conducting contact 13*b* of the fuse, situated on the other end of the fuse 9, which can be seen in FIGS. 7 and 8. Voltage is conducted from the fixed contacts 16 to the ends of the transformer windings situated in the active part 2 of the transformer, which can be seen in FIGS. 7 and 8. When the fuse 9 trips, the pin 12 of the fuse 9 moves out rapidly and strikes the slide 20 shifting it towards the fixing disk 17 to a position in which, after crossing the balance point, a system of the springs 18 imparts further movement to the slide 20, shifting it to the left extreme position. When the slide 20 is in the left extreme position, an interruption in the electric connection between the fuse contact 11*a* and the fixed contact 16 is made, ensuring a simultaneous isolation of all the three phases of supply voltage from the primary windings of the transformer in the active part 2 and enabling a simultaneous connection of the windings of the active part 2 with the grounded disk 17. Grounding of the disk ensures effective disconnection of current if opening of the contacts has been initiated by only one of the fuses.

Figure 6:
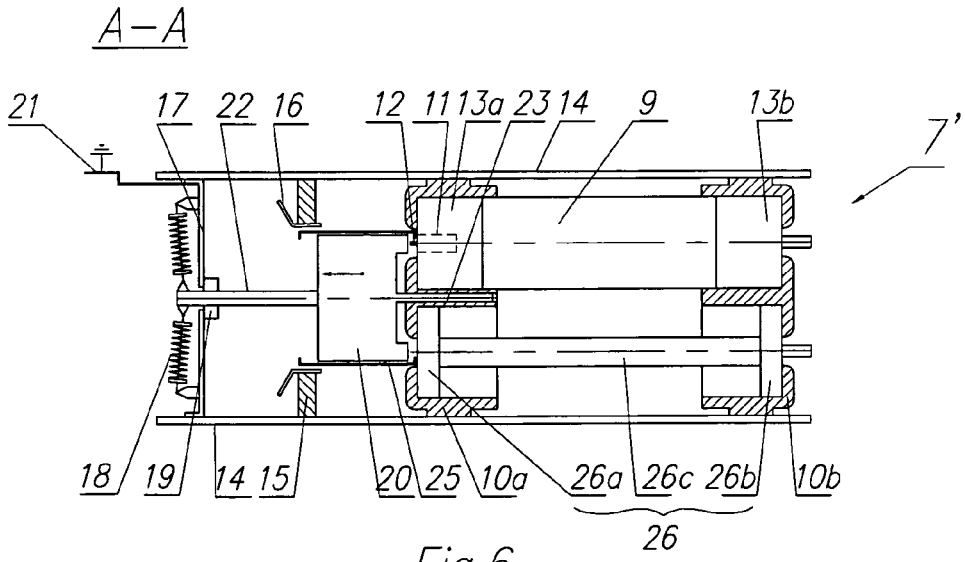
FIG. 6 shows the disconnector in the second embodiment of the invention with two fuses and one jumper, in the A-A section as in FIG. 3.

In the second embodiment of the invention, presented in FIG. 6, where the disconnector is marked 7', one of the fuses 9 which is not connected to the sensor 8 has been replaced by a jumper 26 which consists of a cylindrical front contact of the jumper 26*a*, of a cylindrical back contact of the jumper 25*b* and a conducting pin of the jumper 26*c*, the pin connecting the said contacts. Instead of the pin 26*c*, a simple metal plate can be used as the element that connects the contacts of the jumper 26. The function of the jumper 26 is only conducting current and it does not have any protective functions such as a fuse has, but in the housing 10 it occupies the position of one of the current-limiting fuses 9 and because of that the diameters of the cylindrical contacts of the jumper 26*a* and 26*b* are the same as the diameter of the fuse 9 measured at the place where it is secured in the holders 10*a* and 10*b*. The length of the jumper 26 corresponds to the length of the fuse 9.

KEY TO THE SYMBOLS IN THE DRAWING

1. transformer tank
2. active part of the transformer
3. oil
4. cover
5. high voltage bushing

6. low voltage bushing
7. 7'—disconnector
8. oil pressure and level sensor
9. current-limiting fuse
10. disconnector housing
10*a*—front holder
10*b*—back holder
11. tripping device
12. tripping device pin
13. conducting contacts of the fuse
13*a*—front contact
13*b*—back contact
14. connecting rod of the housing
15. insulating ring of the fixed contacts
16. fixed contact
17. fixing disk
18. spring
19. slide guide
20. slide
21. brass grounding strip
22. slide pilot
23. slide guiding pin
24. port in the holder
25. moving contact
26. jumper
26*a*—front contact of the jumper
26*b*—back contact of the jumper
26*c*—conducting pin of the jumper

The invention claimed is:

1. A disconnector for electric power equipment containing fuses, comprising three cylindrical current-limiting fuses which are situated inside a containing tank filled with dielectric fluid and filled with dielectric fluid each current-limiting fuse is electrically connected with external phase power supply and through fixed contacts and moving contacts of the disconnector with the active part of the electric power equipment, characterized in that the cylindrical current-limiting fuses are situated in a common housing in which there is a slide with a pilot, and the slide has moving contacts inseparably fixed to it, which contacts move together with the slide when the slide makes a to-and-fro motion along an axis of slide travel that takes place as a result of the operation of a tripping device situated in the current-limiting fuses and of compressing and stretching of springs fixed to the pilot and to a fixing disk coupled to said common housing, wherein said cylindrical current-limiting fuses are situated in said common housing in such a way that the longitudinal axes of the cylindrical current-limiting fuses are situated parallel to one another, and a projection of the longitudinal axes on a plane determines three points which when connected to one another form the vertexes of a triangle in whose area a projection of the axis of the slide travel is situated.

2. A disconnector according to claim 1 characterized in that the moving contacts in the open state of the disconnector are in contact with said fixing disk which is grounded.

3. A disconnector according to claim 1, characterized in that the common housing is fixed inside the containing tank of the electric power equipment.

4. A disconnector according to claim 3, characterized in that the common housing is fixed to a cover of the containing tank of the electric power equipment.

* * * * *